US008825495B2

(12) United States Patent
Tsuji et al.

(10) Patent No.: US 8,825,495 B2
(45) Date of Patent: Sep. 2, 2014

(54) ACOUSTIC SIGNAL PROCESSING SYSTEM, ACOUSTIC SIGNAL DECODING APPARATUS, PROCESSING METHOD IN THE SYSTEM AND APPARATUS, AND PROGRAM

(75) Inventors: Minoru Tsuji, Chiba (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 291 days.

(21) Appl. No.: 13/057,219

(22) PCT Filed: Jun. 3, 2010

(86) PCT No.: PCT/JP2010/059440

§ 371 (c)(1),
(2), (4) Date: Feb. 2, 2011

(87) PCT Pub. No.: WO2010/150635

PCT Pub. Date: Dec. 29, 2010

(65) Prior Publication Data

US 2012/0116780 A1 May 10, 2012

(30) Foreign Application Priority Data

Jun. 23, 2009 (JP) ..... P2009-148220

(51) Int. Cl.
*G10L 19/00* (2013.01)

(52) U.S. Cl.
USPC ..... 704/500

(58) Field of Classification Search
USPC ..... 704/219–230, 500–504
See application file for complete search history.

(56) References Cited

U.S. PATENT DOCUMENTS 5,867,819 A 2/1999 Fukuchi et al.
6,226,608 B1 5/2001 Fielder et al.

(Continued)

FOREIGN PATENT DOCUMENTS

JP 09-252254 9/1997
JP 2001-265394 9/2001

(Continued)

OTHER PUBLICATIONS

International Search Report of Corresponding European Patent Application No. 2002-536681, mailed Jun. 24, 2013.

(Continued)

*Primary Examiner* — Abul Azad
(74) *Attorney, Agent, or Firm* — Finnegan, Henderson, Farabow, Garrett & Dunner, L.L.P.

(57) ABSTRACT

The amount of computation in an acoustic signal decoding apparatus for a signal transform process from a frequency domain to a time domain is reduced while realizing the generation of appropriate output acoustic signals.
An output control unit 340 receives, from a code string separating unit 310, pieces of window information including a window shape showing the type window function related to a windowing process of input channels, and, if all the pieces of window information are the same, switches the connections of output switching units 351 to 355 to a frequency domain mixing unit 510. The frequency domain mixing unit 510 mixes frequency domain signals of five channels supplied from a decoding/dequantizing unit 320 on the basis of downmix information that causes the number of output channels to be smaller than the number of input channels. IMDC/windowing processing units 521 and 522 transform frequency domain signals of two channels output from the frequency domain mixing unit 510 into time domain signals, thereby outputting the signals as acoustic signals of two channels.

8 Claims, 11 Drawing Sheets

(56) References Cited

U.S. PATENT DOCUMENTS

| | | | | |
|---|---|---|---|---|
| 6,493,674 | B1 | 12/2002 | Takamizawa | |
| 8,484,019 | B2 * | 7/2013 | Hedelin et al. | 704/219 |
| 2009/0319282 | A1 * | 12/2009 | Allamanche et al. | 704/501 |
| 2010/0286990 | A1 * | 11/2010 | Biswas et al. | 704/500 |

FOREIGN PATENT DOCUMENTS

| | | |
|---|---|---|
| JP | 3279228 | 2/2002 |
| JP | 2002-536681 | 10/2002 |
| JP | 2004-206771 | 7/2004 |
| JP | 2006-146247 | 6/2006 |

OTHER PUBLICATIONS

Supplementary European Search Report in Application No. 10791953.2 dated Nov. 20, 2012, 8 pages.

Bosi, M. et al., "ISO/IEC MPEG-2 Advanced Audio Coding", *Papers*, J. Audio Enc. Soc., vol. 45, No. 10, Oct. 1997, pp. 789-812.

Geiger, R. et al., "Utilizing AACE-ELD for delayless mixing in frequency domain", *Fraunhofer IIS*, Apr. 2007, 5 pages.

International Search Report from the Japanese Patent Office for International Application No. PCT/JP2010/059440, mailing date Jul. 6, 2010.

* cited by examiner

FIG. 7

761 762

| WINDOW INFORMATION | | | FREQUENCY DOMAIN SIGNAL OUTPUT DESTINATION |
|---|---|---|---|
| WINDOWING FORM | WINDOW SHAPE | | |
| | FIRST-HALF PORTION | LATTER-HALF PORTION | |
| LONG_WINDOW | SINE | SINE | FIRST FREQUENCY DOMAIN MIXING UNIT |
| | SINE | KBD | SECOND FREQUENCY DOMAIN MIXING UNIT |
| | KBD | SINE | THIRD FREQUENCY DOMAIN MIXING UNIT |
| | KBD | KBD | FOURTH FREQUENCY DOMAIN MIXING UNIT |
| START_WINDOW | SINE | SINE | FIFTH FREQUENCY DOMAIN MIXING UNIT |
| | SINE | KBD | SIXTH FREQUENCY DOMAIN MIXING UNIT |
| | KBD | SINE | SEVENTH FREQUENCY DOMAIN MIXING UNIT |
| | KBD | KBD | EIGHTH FREQUENCY DOMAIN MIXING UNIT |
| SHORT_WINDOW | SINE | SINE | NINTH FREQUENCY DOMAIN MIXING UNIT |
| | SINE | KBD | TENTH FREQUENCY DOMAIN MIXING UNIT |
| | KBD | SINE | ELEVENTH FREQUENCY DOMAIN MIXING UNIT |
| | KBD | KBD | TWELFTH FREQUENCY DOMAIN MIXING UNIT |
| STOP_WINDOW | SINE | SINE | THIRTEENTH FREQUENCY DOMAIN MIXING UNIT |
| | SINE | KBD | FOURTEENTH FREQUENCY DOMAIN MIXING UNIT |
| | KBD | SINE | FIFTEENTH FREQUENCY DOMAIN MIXING UNIT |
| | KBD | KBD | SIXTEENTH FREQUENCY DOMAIN MIXING UNIT |

FIG. 8

771 772

| | WINDOWING FORM | WINDOW SHAPE | |
|---|---|---|---|
| | | FIRST-HALF PORTION | LATTER-HALF PORTION |
| FIRST IMDCT/ WINDOWING UNIT | LONG_WINDOW | SINE | SINE |
| SECOND IMDCT/ WINDOWING UNIT | LONG_WINDOW | SINE | KBD |
| THIRD IMDCT/ WINDOWING UNIT | LONG_WINDOW | KBD | SINE |
| FOURTH IMDCT/ WINDOWING UNIT | LONG_WINDOW | KBD | KBD |
| FIFTH IMDCT/ WINDOWING UNIT | START_WINDOW | SINE | SINE |
| SIXTH IMDCT/ WINDOWING UNIT | START_WINDOW | SINE | KBD |
| SEVENTH IMDCT/ WINDOWING UNIT | START_WINDOW | KBD | SINE |
| EIGHTH IMDCT/ WINDOWING UNIT | START_WINDOW | KBD | KBD |
| NINTH IMDCT/ WINDOWING UNIT | SHORT_WINDOW | SINE | SINE |
| TENTH IMDCT/ WINDOWING UNIT | SHORT_WINDOW | SINE | KBD |
| ELEVENTH IMDCT/ WINDOWING UNIT | SHORT_WINDOW | KBD | SINE |
| TWELFTH IMDCT/ WINDOWING UNIT | SHORT_WINDOW | KBD | KBD |
| THIRTEENTH IMDCT/ WINDOWING UNIT | STOP_WINDOW | SINE | SINE |
| FOURTEENTH IMDCT/ WINDOWING UNIT | STOP_WINDOW | SINE | KBD |
| FIFTEENTH IMDCT/ WINDOWING UNIT | STOP_WINDOW | KBD | SINE |
| SIXTEENTH IMDCT/ WINDOWING UNIT | STOP_WINDOW | KBD | KBD |

ACOUSTIC SIGNAL PROCESSING SYSTEM, ACOUSTIC SIGNAL DECODING APPARATUS, PROCESSING METHOD IN THE SYSTEM AND APPARATUS, AND PROGRAM

TECHNICAL FIELD

The present invention relates to an acoustic signal processing system, and particularly relates to an acoustic signal processing system that downmixes encoded acoustic signals, an acoustic signal decoding apparatus, a processing method in the system and apparatus, and a program causing a computer to execute the method.

BACKGROUND ART

Conventionally, as acoustic signal encoding apparatuses, apparatuses that generate encoded acoustic data by transforming acoustic signals of a plurality of input channels into frequency domains and encoding frequency domain signals obtained through the transforming have been generally used. Accordingly, acoustic signal decoding apparatuses that decode the encoded acoustic data, thereby transforming frequency domain signals into time domain signals and outputting the signals as output acoustic signals, have become widespread.

Many of such acoustic signal decoding apparatuses have a function of outputting output acoustic signals corresponding to the number of output channels smaller than the number of input channels on the basis of a weighting coefficient for reducing the number of output channels of the output acoustic signals to under the number of input channels. For example, there has been suggested an encoded audio decoding apparatus that outputs decoded audio corresponding to the number of output channels by performing weighted addition using the weighting coefficient before transforming frequency domain signals of individual input channels into time domain signals (see, for example, PTL 1).

In this encoded audio decoding apparatus, weighted addition is performed by associating the frequency domain signals of the input channels with each other in accordance with the transform lengths thereof on the basis of transform function selection information showing the transform lengths regarding the individual frequency domain signals. This is because weighted addition (mixing) cannot be performed on the frequency domain signals of the input channels unless the windowing processes performed on the frequency domain signals of the individual input channels are the same.

CITATION LIST

Patent Literature

PTL 1: Japanese Patent No. 3279228 (FIG. 1)

SUMMARY OF INVENTION

Technical Problem

In the above-described related art, weighted addition is performed on the frequency domain signals, whereby the number of channels of the frequency domain signals can be reduced to under the number of input channels. Accordingly, a computation process for transforming the frequency domain signals into time domain signals can be reduced. However, whether weighted addition in the frequency domain can be performed or not is determined with reference to only the type of transform length regarding the frequency domain signals of the individual channels, and thus the frequency domain signals may be mixed if the transform lengths thereof are the same, even if the window shapes applied to the frequency domain signals are different from each other.

For example, in an AAC (Advanced Audio Coding) method, not only a transform length but also the type of window shape can be changed on the basis of the characteristic of an input acoustic signal. Therefore, if it is determined whether mixing in the frequency domain can be performed or not on the basis of only the transform lengths of frequency domain signals, frequency domain signals with different window shapes may be mixed together, so that appropriate output acoustic signals cannot be generated in some cases.

The present invention has been made in view of such circumstances, and an object thereof is to reduce the amount of computation of an acoustic signal decoding apparatus for a signal transform process from a frequency domain to a time domain, while realizing the generation of appropriate output acoustic signals.

Solution to Problem

The present invention has been made to solve the above-described problems, and a first aspect thereof is an acoustic signal decoding apparatus including: an output control unit configured to perform control to simultaneously output frequency domain signals having identical pieces of window information on the basis of the window information including a window shape showing the type of window function related to the frequency domain signals that are obtained by performing a windowing process on acoustic signals of a plurality of input channels; a frequency domain mixing unit configured to mix the frequency domain signals of the input channels having the identical pieces of window information on the basis of downmix information and output the signals as frequency domain signals corresponding to the number of output channels smaller than the number of the input channels; and an output sound generating unit configured to generate acoustic signals of the output channels by transforming the frequency domain signals of the output channels output from the frequency domain mixing unit into time domain signals and by performing the windowing process on the time domain signals obtained through the transforming, a processing method therefor, and a program causing a computer to execute the method. Accordingly, an operation is provided in which the frequency domain signals having the identical pieces of window information, including the window shape showing the type of window function, are mixed on the basis of the downmix information, whereby the frequency domain signals corresponding to the number of output channels smaller than the input channels are transformed into time domain signals to generate acoustic signals corresponding to the number of output channels.

Also, in the first aspect, the frequency domain mixing unit may mix the frequency domain signals of the input channels on the basis of the downmix information for respective combinations in the plurality of pieces of window information, and the output sound generating unit may generate the acoustic signals of the output channels by adding the time domain signals of the respective combinations on which the windowing process has been performed. Accordingly, an operation is provided in which the frequency domain signals are added for the respective combinations in the plurality of pieces of window information by the frequency domain mixing unit on the basis of the downmix information, whereby acoustic signals of the output channels are generated. In this case, the output control unit may simultaneously output the frequency domain signals of the input channels to the frequency domain mixing unit in a case where a product value of the number of the combinations in the plurality of pieces of window information and the number of the output channels is smaller than the number of the input channels. Accordingly, only in a case where the product value of the number of the combinations in the window information and the number of the output channels is smaller than the number of the input channels, frequency domain signals of the output channels may be generated by mixing the frequency domain signals of the input channels on the basis of the downmix information.

Also, in the first aspect, the output control unit may control output of the frequency domain signals on the basis of the window information that is set on the basis of the acoustic signals of the input channels and that includes a windowing form showing the type of window, and the output sound generating unit may generate the acoustic signals of the output channels by performing the windowing process on the frequency domain signals of the output channels on the basis of the windowing form and the type of window function shown in the window information. Accordingly, an operation is provided in which the frequency domain signals of the individual channels are mixed on the basis of the combinations of the windowing form and window shape in the window information to generate frequency domain signals of the output channels, the generated frequency domain signals are transformed into time domain signals, and a windowing process is performed thereon on the basis of the windowing information, thereby generating acoustic signals. In this case, the output control unit may control output of the frequency domain signals on the basis of the window information showing the window shape for a first-half portion and a latter-half portion in the windowing form. Accordingly, an operation is provided in which the output of the frequency domain signals is switched by the output control unit on the basis of the window information showing the window shape for the first-half portion and the latter-half portion of the transform length in the windowing form.

Also, a second aspect of the present invention is an acoustic signal processing system that includes an acoustic signal encoding apparatus including a windowing processing unit configured to perform a windowing process on acoustic signals of a plurality of input channels and generate window information including a window shape showing the type of window function in the windowing process, and a frequency converting unit configured to transform the acoustic signals output from the windowing processing unit into frequency domains, thereby generating frequency domain signals, and that includes an acoustic signal decoding apparatus including an output control unit configured to perform control to simultaneously output the frequency domain signals that are output from the acoustic signal encoding apparatus and that have identical pieces of window information related to the frequency domain signals of the input channels, a frequency domain mixing unit configured to mix the frequency domain signals of the input channels having the identical pieces of window information on the basis of downmix information and output the signals as frequency domain signals corresponding to the number of output channels smaller than the number of the input channels, and an output sound generating unit configured to generate acoustic signals of the output channels by transforming the frequency domain signals of the output channels output from the frequency domain mixing unit into time domain signals and by performing the windowing process on the time domain signals obtained through the transforming. Accordingly, an operation is provided in which the frequency domain signals corresponding to the number of output channels, which are generated by mixing the frequency domain signals having the same window information among the frequency domain signals of the input channels generated by the acoustic signal encoding apparatus on the basis of the downmix information, are transformed into time domain signals, and a windowing process is performed on the time domain signals obtained through the transform, thereby generating acoustic signals of the output channels.

Advantageous Effects of Invention

According to the present invention, an excellent effect can be obtained in which the amount of computation in an acoustic signal decoding apparatus for a signal transform process from a frequency domain to a time domain can be reduced while realizing the generation of appropriate output acoustic signals.

BRIEF DESCRIPTION OF DRAWINGS

FIG. 7 is a diagram illustrating an example of selecting output destinations by first to fifth output selecting units 711 to 715 according to the second embodiment of the present invention.

FIG. 8 is a diagram illustrating an example of windowing processes performed by first to sixteenth IMDCT/windowing processing units 731 to 733 and 741 to 743 according to the second embodiment of the present invention.

DESCRIPTION OF EMBODIMENTS

Hereinafter, embodiments for carrying out the present invention (hereinafter referred to as embodiments) will be described.

The description will be given in the following order.

1. First embodiment (downmix control: an example of switching between a downmix process in a time domain and a downmix process in a frequency domain on the basis of window information)

2. Second embodiment (downmix control: an example of performing a downmix process using only frequency domain signals on the basis of window information)

3. Third embodiment (downmix control: an example of switching between a downmix process in a time domain and a downmix process in a frequency domain on the basis of the number of combinations of window information)

1. First Embodiment

Configuration Example of Acoustic Signal Encoding Apparatus

Figure 1:
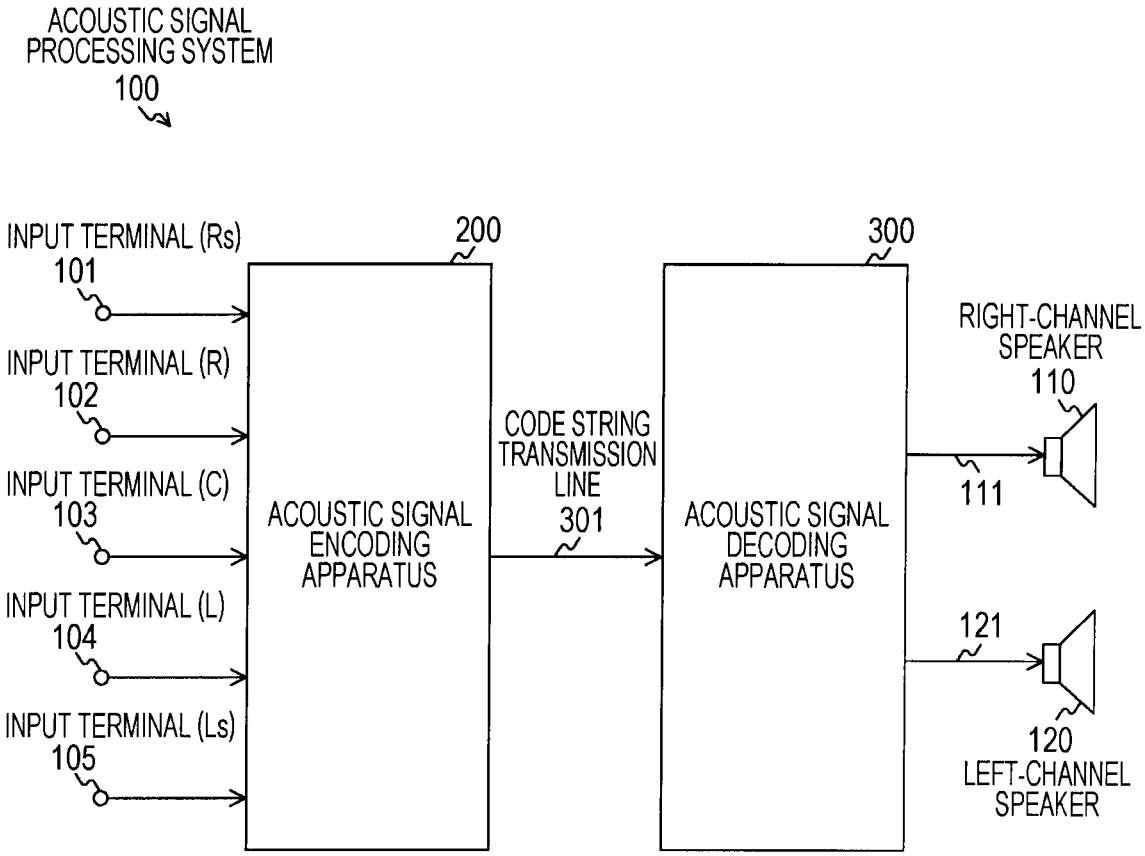
FIG. 1 is a block illustrating a configuration example of an acoustic signal processing system according to a first embodiment of the present invention.

FIG. 1 is a block illustrating a configuration example of an acoustic signal processing system according to a first embodiment of the present invention. The acoustic signal processing system 100 includes an acoustic signal encoding apparatus 200 that encodes acoustic signals corresponding to the number of a plurality of input channels, and an acoustic signal decoding apparatus 300 that decodes the encoded acoustic signals and outputs them in the number of output channels smaller than the number of input channels. Also, the acoustic signal processing system 100 includes two speakers: a right-channel speaker 110 and a left-channel speaker 120, which output acoustic signals of two channels output from the acoustic signal decoding apparatus 300 in the form of acoustic waves.

The acoustic signal encoding apparatus 200 transforms acoustic signals of five channels input from input terminals 101 to 105 into digital signals, and encodes the digital signals obtained through the transform. The acoustic signal encoding apparatus 200 is supplied with an acoustic signal of a right surround channel (Rs) from the input terminal 101, is supplied with an acoustic signal of a right channel (R) from the input terminal 102, and is supplied with an acoustic signal of a center channel (C) from the input terminal 103. Furthermore, the acoustic signal encoding apparatus 200 is supplied with an acoustic signal of a left channel (L) from the input terminal 104 and is supplied with an acoustic signal of a left surround channel (Ls) from the input terminal 105.

The acoustic signal encoding apparatus 200 performs encoding on individual acoustic signals, in which the number of input channels is five, supplied from the input terminals 101 to 105. Also, the acoustic signal encoding apparatus 200 multiplexes the individual encoded acoustic signals and information about the encoding, thereby supplying it as encoded acoustic data to the acoustic signal decoding apparatus 300 via a code string transmission line 301.

The acoustic signal decoding apparatus 300 decodes the encoded acoustic data supplied from the code string transmission line 301, thereby generating acoustic signals of two channels, corresponding to the number of output channels smaller than the number of input channels. The acoustic signal decoding apparatus 300 extracts the encoded acoustic signals from the encoded acoustic data and decodes the extracted encoded acoustic data of five channels, thereby generating acoustic signals of two channels.

Also, the acoustic signal decoding apparatus 300 outputs one of the generated acoustic signals of two channels, that is, the acoustic signal of the right channel, to the right-channel speaker 110 via a signal line 111. Also, the acoustic signal decoding apparatus 300 outputs the other signal, that is, the acoustic signal of the left channel, to the left-channel speaker 120 via a signal line 121.

In this way, in the acoustic signal processing system 100, the acoustic signals of five channels that are encoded by the acoustic signal encoding apparatus 200 are decoded by the acoustic signal decoding apparatus 300, so that the acoustic signals of two channels are output to the speakers 110 and 120. Note that the acoustic signal processing system 100 is an example of the acoustic signal processing system described in the claims.

Note that, although a description has been given here as an example under the assumption that the number of input channels and the number of output channels are five and two, respectively, the present invention is not limited to this. In an embodiment of the present invention, the number of output channels may be smaller than the number of input channels. For example, the number of input channels may be three and the number of output channels may be one. Next, a specific configuration example of the acoustic signal encoding apparatus 200 will be described below with reference to the drawings.

[Configuration Example of Acoustic Signal Encoding Apparatus 200]

Figure 2:
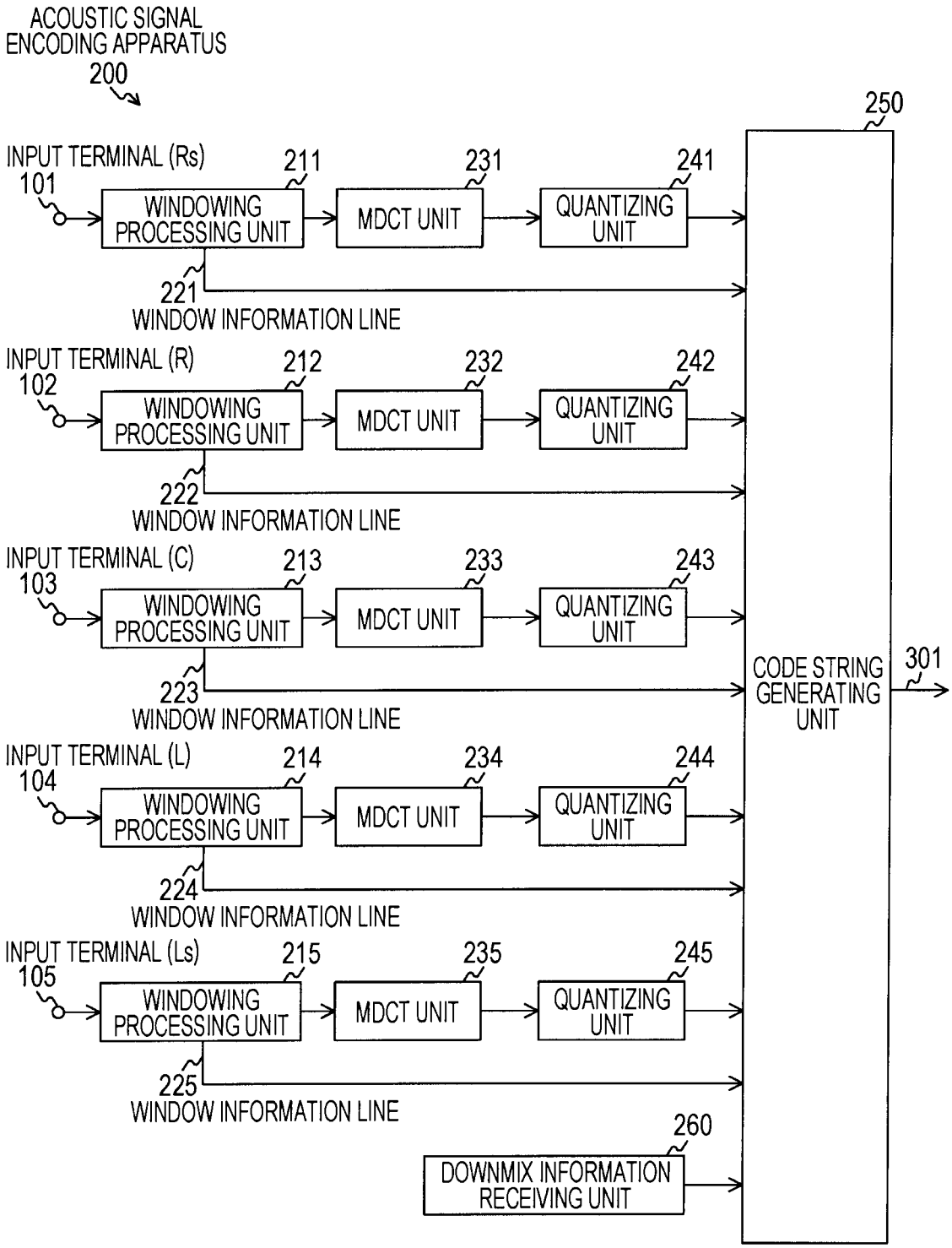
FIG. 2 is a block diagram illustrating a configuration example of an acoustic signal encoding apparatus 200 according to the first embodiment of the present invention.

FIG. 2 is a block diagram illustrating a configuration example of the acoustic signal encoding apparatus 200 according to the first embodiment of the present invention. Here, as an example, the acoustic signal encoding apparatus 200 that is realized by the standard of AAC is assumed.

The acoustic signal encoding apparatus 200 includes windowing processing units 211 to 215, MDCT units 231 to 235, quantizing units 241 to 245, a code string generating unit 250, and a downmix information receiving unit 260.

The windowing processing units 211 to 215 perform windowing processes on acoustic signals of individual input channels input from the input terminals 101 to 105, respectively, in accordance with the characteristics of the acoustic signals of the individual input channels. That is, the windowing processing unit 211 performs a windowing process on the acoustic signal of the right surround channel, the windowing processing unit 212 performs a windowing process on the acoustic signal of the right channel, and the windowing processing unit 213 performs a windowing process on the acoustic signal of the center channel. Also, the windowing processing unit 214 performs a windowing process on the acoustic signal of the left channel, and the windowing processing unit 215 performs a windowing process on the acoustic signal of the left surround channel.

Specifically, the windowing processing units 211 to 215 sample an acoustic signal in a certain period and generate a time domain signal, which is a discrete signal of 2048 samples obtained through the sampling, as a frame. The windowing processing units 211 to 215 shift the preceding frame by a half frame (1024 samples) so as to generate the next frame.

That is, the windowing processing units 211 to 215 generate the next frame so that the latter-half portion of the preceding frame (half frame) overlaps the first-half portion of the next frame. Accordingly, the amount of data of the frequency domain signals generated through MDCT (Modified Discrete Cosine Transform) in the MDCT units 231 to 235 can be suppressed.

Also, the windowing processing units 211 to 215 perform a windowing process on frames in order to suppress distortion that occurs by dividing an acoustic signal into frames. Specifically, the windowing processing units 211 to 215 select a windowing form for one frame from among windowing forms representing four types of windows on the basis of the characteristics of time domain signals of the individual channels in accordance with the convention of AAC.

The windowing processing units 211 to 215 select any one of window shapes representing two types of window functions for each of the first-half portion and the latter-half portion in the selected windowing form. At this time, the windowing processing units 211 to 215 select, as the window shape of the first-half portion of the current frame, the same window shape as that of the latter-half portion of the preceding frame, in order to cancel the connection distortion between the current and preceding frames. That is, the windowing processing units 211 to 215 select the same window shape for the overlapped portion between the current and preceding frames.

On the basis of the selected windowing form and the window shapes of the first-half portion and the latter-half portion with respect to the form, the windowing processing units 211 to 215 perform a windowing process on time domain signals and generate window information showing a combination of the windowing form and the window shapes.

Also, the windowing processing units 211 to 215 supply the respective time domain signals on which the windowing process has been performed to the MDCT units 231 to 235. Also, the windowing processing units 211 to 215 supply the respective pieces of window information of the input channels to the code string generating unit 250 via window information lines 221 to 225, so as to generate acoustic signals in the acoustic signal decoding apparatus 300. Note that the windowing processing units 211 to 215 are an example of the windowing processing unit in the acoustic signal encoding apparatus described in the claims.

The MDCT units 231 to 235 transform the time domain signals supplied from the respective windowing processing units 211 to 215 into frequency domain signals. That is, the MDCT units 231 to 235 transform the acoustic signals output from the windowing processing units 211 to 215 into frequency domains, thereby generating frequency domain signals. Specifically, the MDCT units 231 to 235 transform the time domain signals using an MDCT process, thereby generating frequency domain signals (frequency spectra), which are MDCT coefficients.

Also, the MDCT units 231 to 235 supply the respective frequency domain signals on which the windowing process has been performed, which are the generated frequency domain signals, to the quantizing units 241 to 245. Note that the MDCT units 231 to 235 are an example of the frequency converting unit in the acoustic signal encoding apparatus described in the claims.

The quantizing units 241 to 245 quantize the respective frequency domain signals supplied from the MDCT units 231 to 235 corresponding to the respective input channels. For example, the quantizing units 241 to 245 perform quantization on the basis of the auditory characteristic of a human and control quantization noise in view of a masking effect caused by the auditory characteristic. Also, the quantizing units 241 to 245 supply the respective quantized frequency domain signals to the code string generating unit 250.

The downmix information receiving unit 260 receives downmix information for causing the number of output channels to be smaller than the number of input channels.

For example, the downmix information receiving unit 260 receives a value of a downmix coefficient for setting a weighting coefficient to the each input channel. The downmix information receiving unit 260 outputs the received downmix information to the code string generating unit 250. Note that, although a description has been given here of the example of setting downmix information in the acoustic signal encoding apparatus 200, the downmix information may be set in the acoustic signal decoding apparatus 300.

The code string generating unit 250 encodes the quantized frequency domain signals supplied from the quantizing units 241 to 245, the window information supplied from the windowing processing units 211 to 215, and the downmix information supplied from the downmix information receiving unit 260, thereby generating one code string. The code string generating unit 250 generates encoded acoustic data by individually encoding the quantized frequency domain signals of the individual input channels.

Also, the code string generating unit 250 multiplexes the encoded window information of the individual input channels and downmix information into the encoded acoustic data, thereby supplying it as one code string (bit stream) to the code string transmission line 301.

In this way, the acoustic signal encoding apparatus 200 selects one windowing process from among windowing processes of a plurality of combinations in MDCT transform on the basis of the acoustic signals of the individual input channels, and performs the selected windowing process on a time domain signal. Also, the acoustic signal encoding apparatus 200 transmits, to the acoustic signal decoding apparatus 300 via the code string transmission line 301, encoded acoustic data in which the frequency domain signals on which the windowing process has been performed and the window information about the frequency domain signals are multiplexed. Now, combinations of pieces of window information generated by the respective windowing processing units 211 to 215 will be briefly described below with reference to the drawings.

[Example of Window Information Generated by Windowing Processing Units 211 to 215]

Figure 3:
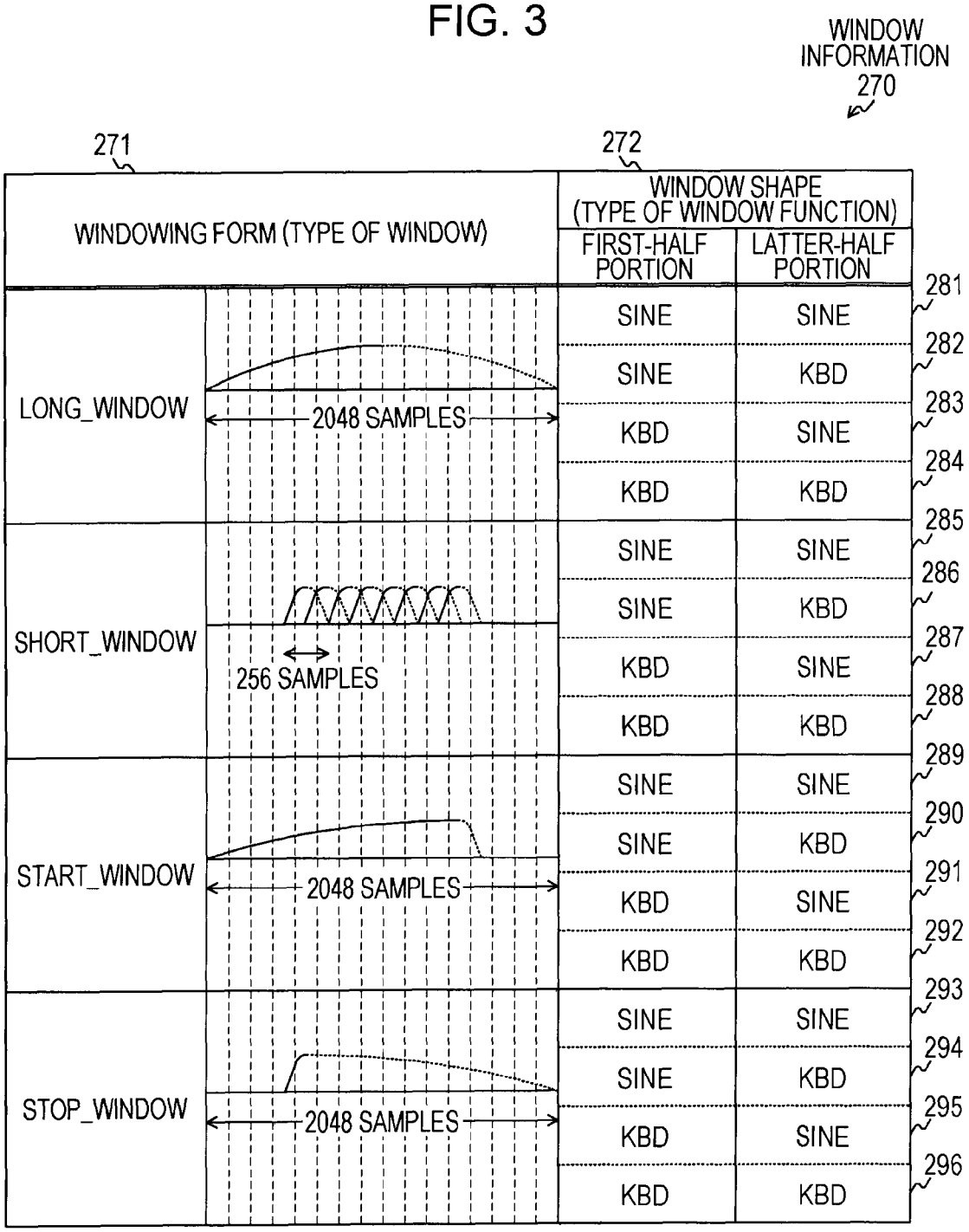
FIG. 3 is a diagram illustrating an example of combinations in window information generated by windowing processing units 211 to 215 according to the first embodiment of the present invention.

FIG. 3 is a diagram illustrating an example of combinations of a widowing form and window shapes in the pieces of window information generated by the windowing processing units 211 to 215 according to the first embodiment of the present invention. Here, as combinations in window information 270, combinations of a windowing form 271 and a window shape 272 of a first-half portion and a latter-half portion with respect to the windowing form 271 are illustrated.

The windowing form 271 shows four windowing forms (LONG_WINDOW, START_WINDOW, SHORT_WINDOW, and STOP_WINDOW) as the types of windows. Also, the windowing form 271 conceptually shows windowing forms with respect to one frame. Here, a solid line portion in the windowing form 271 corresponds to the first-half portion in the window shape 272, and a broken line portion in the windowing form 271 corresponds to the latter-half portion in the window shape 272.

In the windowing form 271, basically, any one of LONG_WINDOW and SHORT_WINDOW is selected on the basis of the characteristic of an acoustic signal of an input channel. LONG_WINDOW in the windowing form 271 is a windowing form that has a transform length, which is a transform section of the MDCT, of 2048 samples, and that is selected in a case where the fluctuation in level of an acoustic signal is small.

On the other hand, SHORT_WINDOW in the windowing form 271 has a transform length of the MDCT of 256 samples and is selected in a case where the level of an acoustic signal suddenly changes, as in an attack sound. Here, eight SHORT_WINDOWs are illustrated. This is because, in a case where SHORT_WINDOW is selected, a frequency domain signal is generated using eight SHORT_WINDOWs with respect to one frame. Accordingly, the frequency components of an acoustic signal of an input channel can be accurately generated compared to in LONG_WINDOW, and thus auditory noise can be suppressed even in a frame in which the signal level of an acoustic signal sharply changes.

Also, in the windowing form 271, START_WINDOW or STOP WINDOW is selected to suppress the connection distortion between adjacent frames in accordance with the switching between LONG_WINDOW and SHORT_WINDOW. START_WINDOW in the windowing form 271 is a windowing form that has a transform length of the MDCT of 2048 samples and that is selected when switching from LONG_WINDOW to SHORT_WINDOW is performed. For example, in a case where an attack sound has been detected, START_WINDOW is selected just before SHORT_WINDOW is selected.

Also, STOP_WINDOW in the windowing form 271 is a windowing form that has a transform length of the MDCT of 2048 samples and that is selected when switching from SHORT_WINDOW to LONG_WINDOW is performed. That is, STOP_WINDOW is selected just before LONG_WINDOW is selected after an attack sound portion ends.

In the first-half portion and the latter-half portion in the window shape 272, two window shapes (sine and KBD) are shown as the types of window functions applied to a windowing form. As for the first-half portion and the latter-half portion in the window shape 272 here, with respect to the current transform section in the windowing form 271, the section overlapping the preceding transform section on a time axis is the first-half portion, and the section overlapping the next transform section is the latter-half portion.

The sine in the window shape 272 represents that a sine window has been selected as a window function. The KBD in the window shape 272 represents that a KBD (Kaiser-Bessel derived) window has been selected as a window function. Additionally, in an MDCT process, the same window shape as that applied to the preceding transform section needs to be selected for the portion (first-half portion or latter-half portion) overlapping the preceding transform section in the current frame, in order to suppress connection distortion.

In this way, in the window information 270, a windowing process is selected on the basis of the four windowing forms and the two window shapes that are applied to the first-half portion and the latter-half portion in these windowing forms, and thus a maximum of sixteen combinations 281 to 296 exist. Here, since the input channels are five channels, the number of combinations in the window information 270 is five at the maximum. Next, a configuration example of the acoustic signal decoding apparatus 300 will be described below with reference to the drawings.

[Configuration Example of Acoustic Signal Decoding Apparatus 300]

Figure 4:
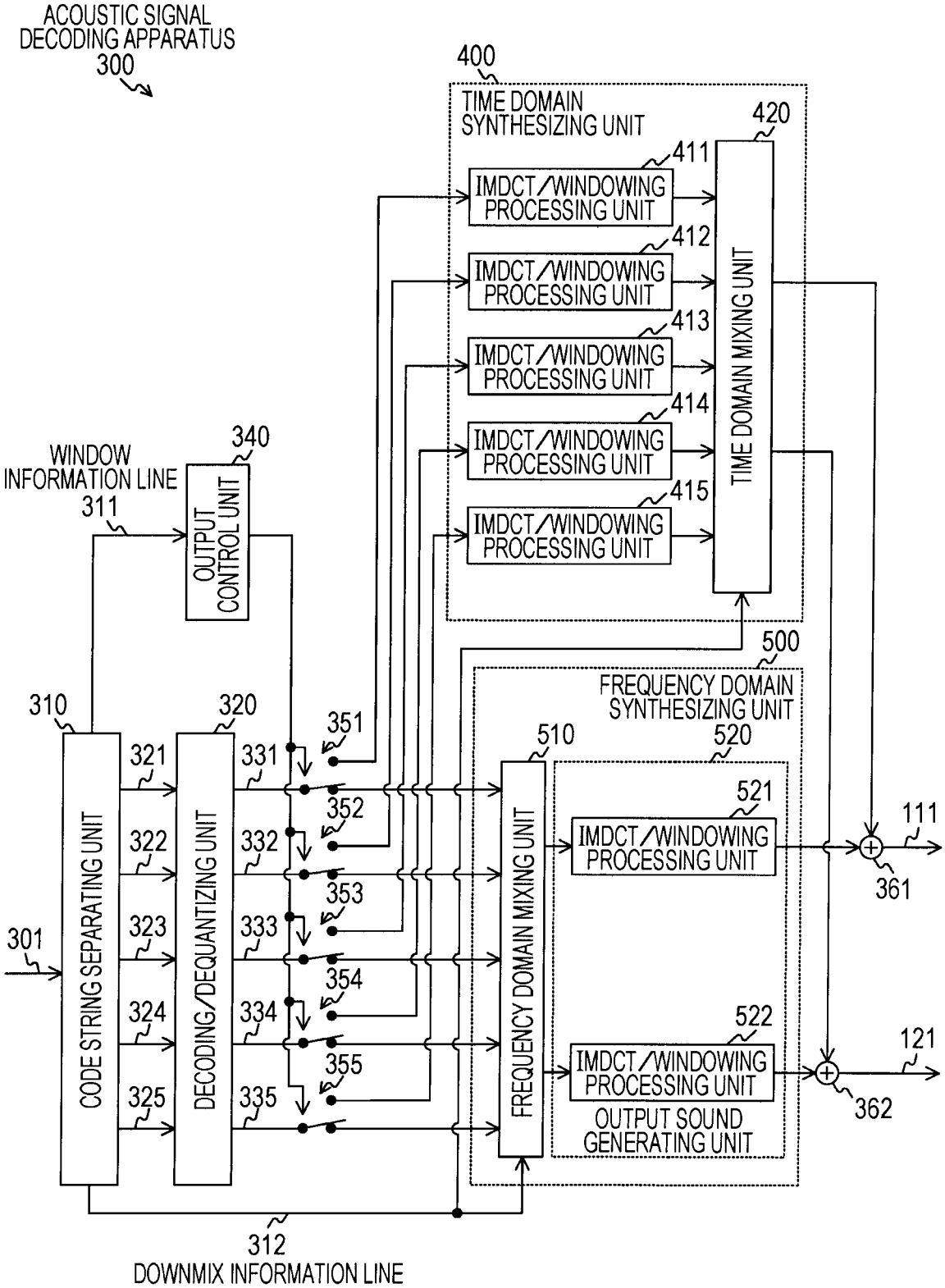
FIG. 4 is a block diagram illustrating a configuration example of an acoustic signal decoding apparatus 300 according to the first embodiment of the present invention.

FIG. 4 is a block diagram illustrating a configuration example of the acoustic signal decoding apparatus 300 according to the first embodiment of the present invention.

The acoustic signal decoding apparatus 300 includes a code string separating unit 310, a decoding/dequantizing unit 320, an output control unit 340, output switching units 351 to 355, adding units 361 and 362, a time domain synthesizing unit 400, and a frequency domain synthesizing unit 500. Also, the time domain synthesizing unit 400 includes IMDCT/windowing processing units 411 to 415 and a time domain mixing unit 420.

Furthermore, the frequency domain synthesizing unit 500 includes a frequency domain mixing unit 510 and an output sound generating unit 520. The output sound generating unit 520 includes IMDCT/windowing processing units 521 and 522.

The code string separating unit 310 separates a code string supplied from the code string transmission line 301. The code string separating unit 310 separates, on the basis of a code string supplied from the code string transmission line 301, the code string into encoded acoustic data of input channels, window information of the individual input channels, and downmix information.

Also, the code string separating unit 310 supplies the encoded acoustic data and window information of the individual input channels to the decoding/dequantizing unit 320. That is, the code string separating unit 310 supplies the encoded acoustic data of the right surround channel to a signal line 321, the encoded acoustic data of the right channel to a signal line 322, and the encoded acoustic data of the center channel to a signal line 323. Furthermore, the code string separating unit 310 supplies the encoded acoustic data of the left channel to a signal line 324, and the encoded acoustic data of the left surround channel to a signal line 325.

Also, the code string separating unit 310 supplies the window information of the individual input channels to the output control unit 340 via a window information line 311. Also, the code string separating unit 310 supplies downmix information to the time domain mixing unit 420 and the frequency domain mixing unit 510 via a downmix information line 312.

The decoding/dequantizing unit 320 decodes and dequantizes the encoded acoustic data of the individual input channels, thereby generating frequency domain signals, which are MDCT coefficients. The decoding/dequantizing unit 320 supplies, in accordance with the control by the output control unit 340, the generated frequency domain signals and window information of the individual input channels to any one of the time domain synthesizing unit 400 and the frequency domain synthesizing unit 500.

Specifically, the decoding/dequantizing unit 320 supplies the generated frequency domain signals of the individual input channels to the output switching units 351 to 355, respectively. That is, the decoding/dequantizing unit 320 supplies the frequency domain signal of the right surround channel to a signal line 331, the frequency domain signal of the right channel to a signal line 332, and the frequency domain signal of the center channel to a signal line 333. Furthermore, the decoding/dequantizing unit 320 supplies the frequency domain signal of the left channel to a signal line 334, and the frequency domain signal of the left surround channel to a signal line 335.

The output switching units 351 to 355 are switches for outputting the frequency domain signals supplied from the signal lines 331 to 335 to any one of the time domain synthesizing unit 400 and the frequency domain synthesizing unit 500 in accordance with the control by the output control unit 340. The output switching units 351 to 355 simultaneously output all the frequency domain signals of the input channels to the IMDCT/windowing processing units 411 to 415 or the frequency domain mixing unit 510 in accordance with the control by the output control unit 340.

The output control unit 340 switches the connections of the output switching units 351 to 355 on the basis of the windowing form and the window shapes included in the window information of the individual input channels supplied from the window information line 311. That is, the output control unit 340 controls the output destinations of the frequency domain signals of the input channels on the basis of the combinations of the windowing form and the window shapes of the first-half portion and the latter-half portion in the windowing form in the window information illustrated in FIG. 3.

The output control unit 340 determines whether the pieces of window information of the individual input channels match each other. Then, if all the pieces of window information match, the output control unit 340 controls the output switching units 351 to 355 so as to connect the signal lines 331 to 335 to the frequency domain mixing unit 510.

On the other hand, if all the pieces of window information do not match, the output control unit 340 controls the output switching units 351 to 355 so as to connect the signal lines 331 to 335 to the IMDCT/windowing processing units 411 to 415. That is, the output control unit 340 controls the output switching units 351 to 355 so that the frequency domain signals having the same window information are simultaneously output to the frequency domain mixing unit 510 on the basis of the window information including the window shapes showing the types of window functions. Note that the output control unit 340 is an example of the output control unit described in the claims.

The time domain synthesizing unit 400 transforms the individual frequency domain signals of the input channels into time domain signals, and then synthesizes the time domain signals of the input channels into time domain signals of output channels on the basis of the downmix information supplied from the code string separating unit 310. That is, the time domain synthesizing unit 400 transforms the frequency domain signals of the five channels into frequency domain signals, and then synthesizes the time domain signals of the five channels into time domain signals of two channels on the basis of the downmix information.

The IMDCT/windowing processing units 411 to 415 generate time domain signals of the input channels on the basis of the frequency domain signals supplied from the signal lines 331 to 335 and the window information. The IMDCT/windowing processing units 411 to 415 transform the individual frequency domain signals into time domain signals using IMDCT (Inverse MDCT) on the basis of the windowing form included in the window information.

Also, the IMDCT/windowing processing units 411 to 415 perform a windowing process on the time domain signals obtained through the transform on the basis of the window information supplied from the code string separating unit 310. Also, the IMDCT/windowing processing units 411 to 415 supply the individual time domain signals on which the windowing process has been performed to the time domain mixing unit 420.

The time domain mixing unit 420 mixes the time domain signals of the five channels supplied from the IMDCT/windowing processing units 411 to 415 on the basis of the downmix information supplied from the code string separating unit 310, thereby generating time domain signals of two channels. That is, the time domain mixing unit 420 generates time domain signals of the output channels fewer than the input channels on the basis of the downmix information supplied from the code string separating unit 310 and the time domain signals of the input channels.

The time domain mixing unit 420 generates time domain signals of two channels by mixing the time domain signals of the five channels on the basis of the following equation, for example, in accordance with the convention of AAC.

[Math. 1]

$$R' = \frac{1}{1+1/\sqrt{2}+A}\cdot\left(R+C/\sqrt{2}+A\cdot Rs\right) \qquad \text{Equation 1}$$

$$L' = \frac{1}{1+1/\sqrt{2}+A}\cdot\left(L+C/\sqrt{2}+A\cdot Ls\right)$$

Here, Rs, R, C, L, and Ls represent the time domain signals of the input channels: right surround channel, right channel, center channel, left channel, and left surround channel. Also, R' and L' represent the time domain signals of the output channels: right channel and left channel.

Also, A is a downmix coefficient, which is selected from among four values: $1/\sqrt{2}$, ½, $\frac{1}{2}\cdot\sqrt{2}$, and 0. Here, it is assumed that this downmix coefficient A is set on the basis of the information included in the encoded acoustic data.

In this way, the time domain mixing unit 420 performs weighted addition (mixing) on the time domain signals of the five channels on the basis of the downmix information related to equation 1 supplied from the code string separating unit 310, thereby generating time domain signals of two channels fewer than the input channels. Such generation of signals corresponding to the number of output channels smaller than the number of input channels based on downmix information is called "downmix" here.

Also, the time domain mixing unit 420 outputs the generated time domain signals of two channels, serving as acoustic signals of two channels, to the adding units 361 and 362. That is, the time domain mixing unit 420 outputs the acoustic signal of the right channel to the adding unit 361 and outputs the acoustic signal of the left channel to the adding unit 362.

The frequency domain synthesizing unit 500 synthesizes the frequency domain signals of the input channels having the same window information into frequency domain signals of the output channels on the basis of the downmix information supplied from the code string separating unit 310, and transforms the synthesized frequency domain signals into time domain signals. That is, the frequency domain synthesizing unit 500 synthesizes the frequency domain signals of the five channels into frequency domain signals of two channels on the basis of the downmix information, and transforms the frequency domain signals of the two channels into time domain signals.

The frequency domain mixing unit 510 mixes the frequency domain signals of the five channels having the same window information supplied from the signal lines 331 to 335 on the basis of the downmix information supplied from the code string separating unit 310, thereby generating frequency domain signals of two channels. The frequency domain mixing unit 510 performs weighted addition (mixing) on the frequency domain signals of the five channels on the basis of the downmix information related to equation 1 supplied from the downmix information line 312, thereby generating frequency domain signals of two channels fewer than the input channels. Accordingly, the frequency domain signals to be output to the output sound generating unit 520 can be reduced from five channels to two channels.

Also, the frequency domain mixing unit 510 outputs the frequency domain signals of the two output channels, which are generated on the basis of the downmix information supplied from the code string separating unit 310, to the output sound generating unit 520. That is, the frequency domain mixing unit 510 mixes the frequency domain signals of the input channels having the same window information including window shapes on the basis of the downmix information, thereby outputting them as frequency domain signals corresponding to the number of output channels smaller than the number of input channels. The frequency domain mixing unit 510 outputs the frequency domain signal of the right channel to the IMDCT/windowing processing unit 521, and outputs the frequency domain signal of the left channel to the IMDCT/windowing processing unit 522. Note that the frequency domain mixing unit 510 is an example of the frequency domain mixing unit described in the claims.

The output sound generating unit 520 transforms the frequency domain signals of the output channels output from the frequency domain mixing unit 510 into time domain signals, and performs a windowing process on the time domain signals obtained through the transform, thereby generating acoustic signals of the output channels. That is, the output sound generating unit 520 performs a windowing process on the frequency domain signals of the output channels on the basis of the windowing form and the type of window function shown in the window information, thereby generating acoustic signals of the output channels. Note that the output sound generating unit 520 is an example of the output sound generating unit described in the claims.

The IMDCT/windowing processing units 521 and 522 transform the frequency domain signals of the output channels into time domain signals on the basis of the window information output from the frequency domain mixing unit 510. The IMDCT/windowing processing units 521 and 522 perform a windowing process on the time domain signals obtained through the transform on the basis of the window information supplied from the frequency domain mixing unit 510. Note that, in a case where the window shapes included in the window information do not match, the window shapes cannot be uniquely specified, and thus the frequency domain signals cannot be appropriately transformed into time domain signals. Also, in a case where the windowing forms included in the window information do not match, the transform lengths of the windowing forms are different, and thus the frequency domain signals cannot be transformed into time domain signals.

Also, the IMDCT/windowing processing units 521 and 522 output the respective time domain signals on which the windowing process has been performed to the adding units 361 and 362 as acoustic signals of the output channels. That is, the IMDCT/windowing processing unit 521 outputs the time domain signal on which the windowing process for the right channel has been performed to the adding unit 361 as an acoustic signal of the right channel. Also, the IMDCT/windowing processing unit 522 outputs the time domain signal on which the windowing process for the left channel has been performed to the adding unit 362 as an acoustic signal of the left channel.

The adding units 361 and 362 output any one the outputs from the time domain synthesizing unit 400 and the frequency domain synthesizing unit 500. In a case where the connection to the signal lines 331 to 335 is switched to the time domain synthesizing unit 400 by the output control unit 340, the adding units 361 and 362 output the acoustic signals of the output channels supplied from the time domain mixing unit 420 to the signal lines 111 and 121.

Also, in a case where the connection to the signal lines 331 to 335 is switched to the frequency domain synthesizing unit 500 by the output control unit 340, the adding units 361 and 362 output the acoustic signals of the output channels supplied from the output sound generating unit 520 to the signal lines 111 and 121.

In this way, by providing the output control unit 340, it can be determined whether pieces of window information including a window shape representing the type of window function in the input channels match each other. Thus, only in a case where all the pieces of window information of the input channels match, the frequency signals in which the pieces of window information match can be output to the frequency domain synthesizing unit 500 while being associated with each other. That is, it can be prevented that frequency domain signals on which windowing processes of different window shapes have been performed are output to the frequency domain synthesizing unit 500 while being associated with each other.

Therefore, in a case where all the pieces of window information match, the frequency domain signals can be reduced to those for output channels fewer than the input channels by the frequency domain mixing unit 510. Accordingly, the amount of computation of IMDCT can be reduced compared to that in the time domain synthesizing unit 400.

[Operation Example of Acoustic Signal Decoding Apparatus 300]

Next, operation of the acoustic signal decoding apparatus 300 according to the first embodiment of the present invention will be described with reference to the drawings.

Figure 5:
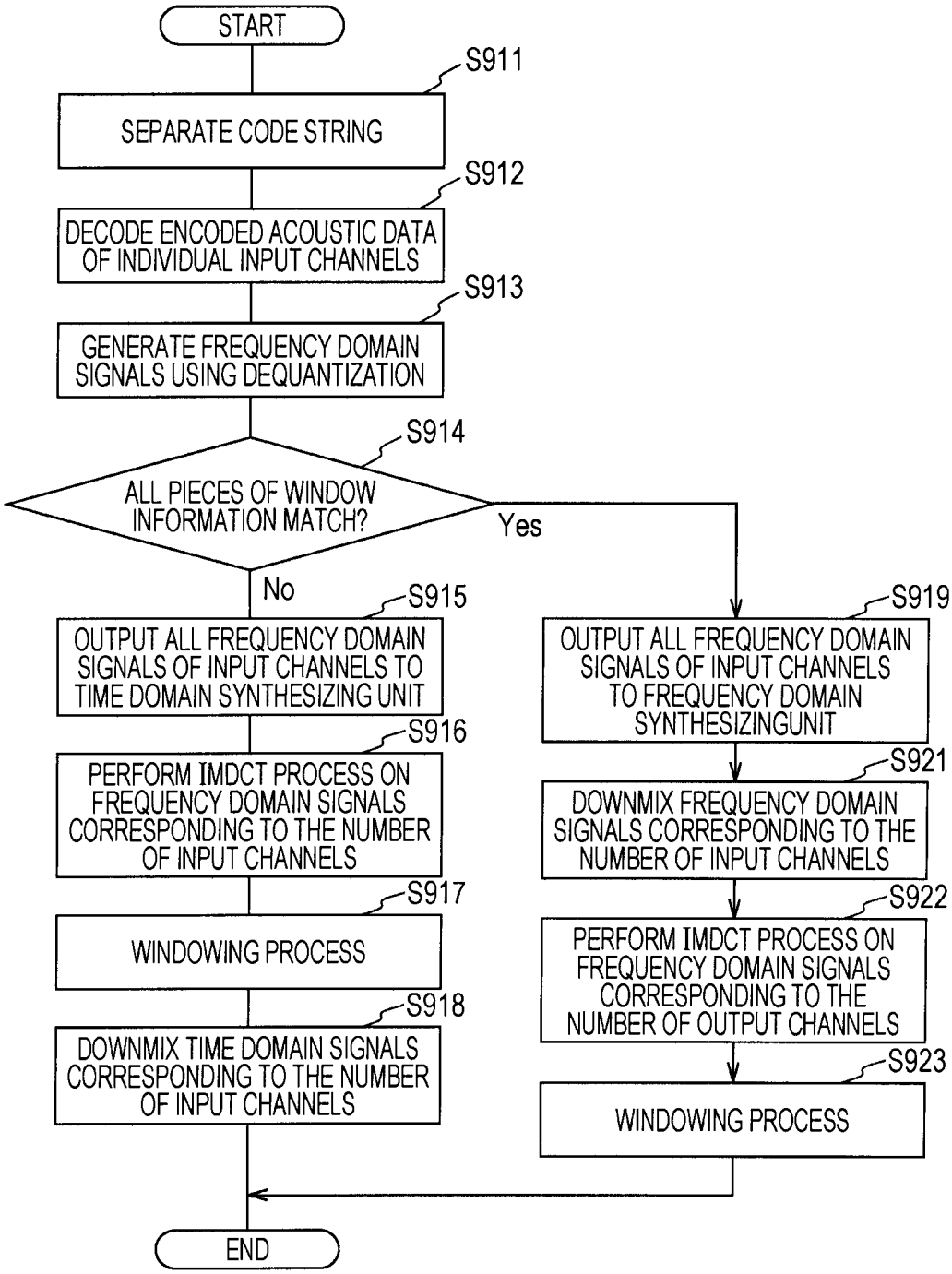
FIG. 5 is a flowchart illustrating a process procedure example of a method for decoding a code string performed by the acoustic signal decoding apparatus 300 according to the first embodiment of the present invention.

FIG. 5 is a flowchart illustrating a process procedure example of a method for decoding a code string performed by the acoustic signal decoding apparatus 300 according to the first embodiment of the present invention.

First, a code string supplied from the code string transmission line 301 is separated into encoded acoustic data of input channels, window information of the input channels, downmix information, and so forth by the code string separating unit 310 (step S911). Then, the encoded acoustic data of the input channels is decoded by the decoding/dequantizing unit 320 (step S912). Subsequently, the encoded acoustic data that has been decoded is dequantized by the decoding/dequantizing unit 320, so that frequency domain signals are generated (step S913).

Next, whether all the pieces of window information of the input channels match is determined by the output control unit 340 on the basis of the window forms and window shapes included in the pieces of window information of the individual input channels supplied from the code string separating unit 310 (step S914). Then, if all the pieces of window information match, the connections of the output switching units 351 to 355 are switched by the output control unit 340 so that all the frequency domain signals of the input channels are output to the frequency domain synthesizing unit 500 (step S919).

That is, the output switching units 351 to 355 are controlled by the output control unit 340 so that the frequency domain signals having the same window information are output while being associated with each other on the basis of the window information including the window shapes representing the types of window functions. Note that steps S914 and S919 are an example of the output control procedure described in the claims.

After that, the frequency domain signals corresponding to the number of input channels are mixed by the frequency domain mixing unit 510 on the basis of the downmix information supplied from the code string separating unit 310, so that frequency domain signals corresponding to the number of output channels are generated (step S921). That is, the frequency domain signals of the input channels are mixed by the frequency domain mixing unit 510 on the basis of the downmix information, and frequency domain signals corresponding to the number of output channels smaller than the number of input channels are output. Note that step S921 is an example of the frequency domain mixing procedure described in the claims.

Then, the frequency domain signals of two output channels are transformed by the IMDCT/windowing processing units 521 and 522 using an IMDCT process, so that time domain signals are generated (step S922). Subsequently, a windowing process is performed on the generated time domain signals by the IMDCT/windowing processing units 521 and 522, so that the signals are output as acoustic signals of the output channels (step S923).

That is, the frequency domain signals of the output channels supplied from the frequency domain mixing unit 510 are transformed into time domain signals and a windowing process is performed on the time domain signals obtained through the transform by the output sound generating unit 520, so that acoustic signals of the output channels are generated. Note that steps S922 and S923 are an example of the output sound generation procedure described in the claims.

On the other hand, if all the pieces of window information do not match in step S914, the connections of the output switching units 351 to 355 are switched by the output control unit 340 so that all the frequency domain signals of the input channels are output to the time domain synthesizing unit 400 (step S915). After that, the frequency domain signals of the five input channels are transformed by the IMDCT/windowing processing units 411 to 415 through an IMDCT process, so that time domain signals are generated (step S916).

Subsequently, a windowing process is performed on the generated time domain signals by the IMDCT/windowing processing units 411 to 415, and the signals are output as time domain signals corresponding to the number of input channels (step S917). Then, the time domain signals corresponding to the number of input channels are mixed by the time domain mixing unit 420 on the basis of the downmix information supplied from the code string separating unit 310, and the signals are output as acoustic signals of the output channels (step S918). Then, the process in the method for decoding a code string ends.

As described above, in the first embodiment of the present invention, in a case where all the window shapes and windowing forms included in pieces of window information match, all the frequency domain signals of the input channels are mixed, so that frequency domain signals corresponding to the number of output channels smaller than the number of input channels can be generated. Accordingly, the number of channels of the frequency domain signals reduces, and thus a computation process of time domain transform (IMDCT) for transforming frequency domain signals into time domain signals can be reduced.

Note that, although a description has been given here as an example of mixing frequency domain signals in a case where all the pieces of window information of input channels match, acoustic signals can be appropriately generated by mixing frequency domain signals even in a case where all the pieces of window information do not match. Next, an example of an acoustic signal decoding apparatus that generates acoustic signals of output channels without providing the time domain synthesizing unit 400 even in a case where all the pieces of window information do not match will be described below as a second embodiment with reference to the drawings.

2. Second Embodiment

Configuration Example of Acoustic Signal Decoding Apparatus

Figure 6:
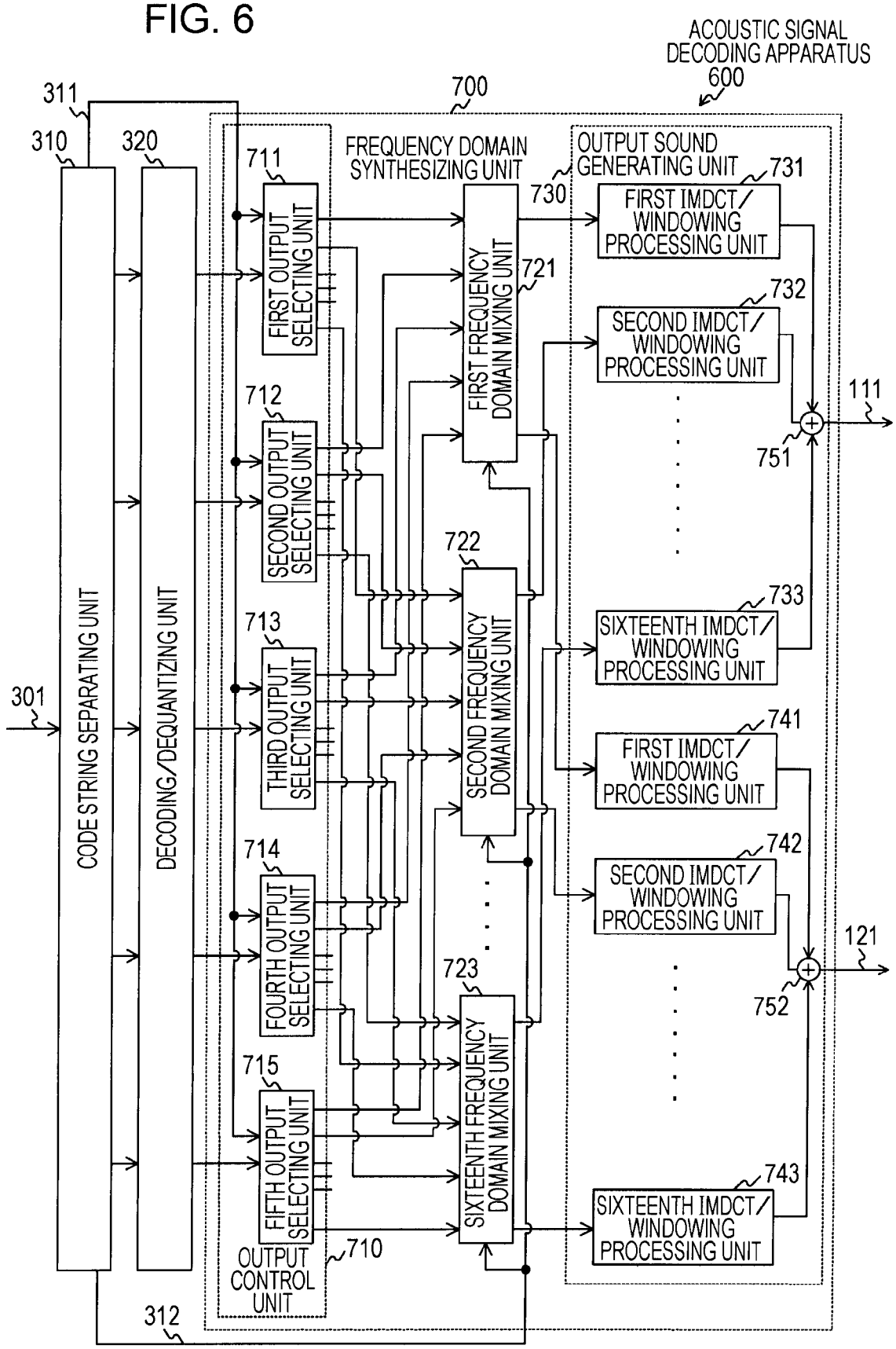
FIG. 6 is a block diagram illustrating a configuration example of an acoustic signal decoding apparatus according to a second embodiment of the present invention.

FIG. 6 is a block diagram illustrating a configuration example of an acoustic signal decoding apparatus according to a second embodiment of the present invention. The acoustic signal decoding apparatus 600 includes a frequency domain synthesizing unit 700, instead of the output control unit 340, the output switching units 351 to 355, the time domain synthesizing unit 400, the frequency domain synthesizing unit 500, and the adding units 361 and 362 in the acoustic signal decoding apparatus 300 illustrated in FIG. 4. Here, the configurations other than the frequency domain synthesizing unit 700 are the same as those illustrated in FIG. 4, and are thus denoted by the same reference numerals as in FIG. 4 and a detailed description thereof will be omitted here.

The frequency domain synthesizing unit 700 includes an output control unit 710, first to sixteenth frequency domain mixing units 721 to 723, and an output sound generating unit 730. Also, the output sound generating unit 730 includes first to sixteenth IMDCT/windowing processing units 731 to 733 corresponding to the right channel, first to sixteenth IMDCT/windowing processing units 741 to 743 corresponding to the left channel, and adding units 751 and 752.

The output control unit 710 performs control to output frequency domain signals of input channels by associating each of them with any of the first to sixteenth frequency domain mixing units 721 to 723, which correspond to combinations of windowing forms and window shapes in a plurality of pieces of window information, in accordance with the combinations. Note that the output control unit 710 is an example of the output control unit described in the claims.

This output control unit 710 includes first to fifth output selecting units 711 to 715 that correspond to the respective input channels. The first to fifth output selecting units 711 to 715 select the output destinations of the frequency domain signals of the input channels supplied from the decoding/dequantizing unit 320 on the basis of combinations of window shapes and a windowing form included in the window information supplied from the code string separating unit 310. For example, the first output selecting unit 711 selects the output destination of the frequency domain signal of the right surround channel supplied from the decoding/dequantizing unit 320 on the basis of the combination of the windowing form and the window shapes in the window information of the right surround channel.

Also, the first to fifth output selecting units 711 to 715 supply each of the frequency domain signals supplied from the decoding/dequantizing unit 320 to the output destination selected on the basis of the combination in the window information, that is, to any of the first to sixteenth frequency domain mixing units 721 to 723 corresponding to the combination. For example, the first output selecting unit 711 outputs, on the basis of the combination in the window information of the right surround channel, the frequency domain signal of the right surround channel to any of the first to sixteenth frequency domain mixing units 721 to 723 corresponding to the combination. Also, the first to fifth output selecting units 711 to 715 supply window information to any of the first to sixteenth frequency domain mixing units 721 to 723 corresponding to the combination.

The first to sixteenth frequency domain mixing units 721 to 723 are similar to the frequency domain mixing unit 510 illustrated in FIG. 4. The first to sixteenth frequency domain mixing units 721 to 723 mix the frequency domain signals of the input channels in accordance with the respective combinations in a plurality of pieces of window information on the basis of the downmix information supplied from the code string separating unit 310 via the downmix information line 312. The first to sixteenth frequency domain mixing units 721 to 723 output the mixed frequency domain signals of the input channels to the first to sixteenth IMDCT/windowing processing units 731 to 733 and 741 to 743, in the number of output channels smaller than the number of input channels.

For example, the first frequency domain mixing unit 721 outputs the frequency domain signals of the right channel and the left channel to the first IMDCT/windowing processing units 731 and 741, respectively, on the basis of the frequency domain signals supplied from the first to fourth output selecting units 711 to 714 and the downmix information. Also, for example, the sixteenth frequency domain mixing unit 723 outputs the frequency domain signal of the left channel to the sixteenth IMDCT/windowing processing unit 743 on the basis of the frequency domain signal of the left surround channel supplied from the fifth output selecting unit 715 and the downmix information.

Also, the first to sixteenth frequency domain mixing units 721 to 723 output the window information supplied from the output control unit 710 to the first to sixteenth IMDCT/windowing processing units 731 to 733 and 741 to 743. Note that the first to sixteenth frequency domain mixing units 721 to 723 are an example of frequency domain mixing unit described in the claims.

The output sound generating unit 730 transforms the frequency domain signals of the output channels output from the first to sixteenth frequency domain mixing units 721 to 723 into time domain signals, and performs a windowing process on the time domain signals obtained through the transform. The output sound generating unit 730 adds the time domain signals on which the windowing process has been performed for the respective output channels, thereby generating acoustic signals of the output channels. Note that the output sound generating unit 730 is an example of the output sound generating unit described in the claims.

The first to sixteenth IMDCT/windowing processing units 731 to 733 transform the frequency domain signals of the output channels into time domain signals on the basis of the frequency domain signals of the right channel and the window information supplied from the first to sixteenth frequency domain mixing units 721 to 723. The first to sixteenth IMDCT/windowing processing units 731 to 733 perform a windowing process on the time domain signals obtained through the transform on the basis of the window information supplied from the first to sixteenth frequency domain mixing units 721 to 723.

Also, the first to sixteenth IMDCT/windowing processing units 731 to 733 output the respective time domain signals on which the windowing process has been performed to the adding unit 751. That is, the first to sixteenth IMDCT/windowing processing units 731 to 733 output the time domain signals on which the windowing process for the right channel has been performed to the adding unit 751.

The first to sixteenth IMDCT/windowing processing units 741 to 743 transform the frequency domain signals of the left channel into time domain signals on the basis of the frequency domain signals of the left channel and the window information supplied from the first to sixteenth frequency domain mixing units 721 to 723. The first to sixteenth IMDCT/windowing processing units 741 to 743 perform a windowing process on the time domain signals obtained through the transform on the basis of the window information supplied from the first to sixteenth frequency domain mixing units 721 to 723. Also, the first to sixteenth IMDCT/windowing processing units 741 to 743 output the respective time domain signals on which the windowing process has been performed to the adding unit 752.

The adding units 751 and 752 add the time domain signals output from the first to sixteenth IMDCT/windowing processing units 731 to 733 and 741 to 743, thereby generating acoustic signals of the output channels. The adding unit 751 adds the time domain signals supplied from the first to sixteenth IMDCT/windowing processing units 731 to 733, thereby outputting acoustic signals of the right channel via the signal line 111. The adding unit 752 adds the time domain signals supplied from the first to sixteenth IMDCT/windowing processing units 741 to 743, thereby outputting acoustic signals of the left channel via the signal line 121.

In this way, the first to sixteenth frequency domain mixing units 721 to 723 corresponding to the combinations in the window information are provided to mix the frequency domain signals of the input channels, so that acoustic signals of the output channels can be generated. Now, an example of output destinations selected by the first to fifth output selecting units 711 to 715 will be briefly described below with reference to the drawings.

[Example of Selecting Output Destinations by Output Control Unit 710]

FIG. 7 is a diagram illustrating an example of selecting output destinations by the first to fifth output selecting units 711 to 715 according to the second embodiment of the present invention. Here, a frequency domain signal output destination 762 for each combination in window information 761 is illustrated.

The window information 761 shows combinations of a windowing form and window shapes related to the windowing processes performed by the windowing processing units 211 to 215 in the acoustic signal encoding apparatus 200. The number of combinations in the window information 761 is sixteen, as described with reference to FIG. 3. The frequency domain signal output destination 762 shows the output destinations of the frequency domain signals of the input channels for the respective combinations in the window information 761.

In this example, when the windowing form shown in the windowing information is LONG_WINDOW and when the window shape in the first-half portion and the latter-half portion is a sine window, the first to fifth output selecting units 711 to 715 output the frequency domain signals to the first frequency domain mixing unit 721.

In this way, output destinations are selected for the respective combinations in the window information 761 by the first to fifth output selecting units 711 to 715, so that the frequency domain signals having the same window information can be output to the first to sixteenth frequency domain mixing units 721 to 723 while being associated with each other. Next, an example of windowing processes in the first to sixteenth IMDCT/windowing processing units 731 to 733 and 741 to 743 in this example will be described with reference to the drawings.

[Example of Windowing Process in Each IMDCT/Windowing Processing Unit]

FIG. 8 is a diagram illustrating an example related to the windowing processes performed by the first to sixteenth IMDCT/windowing processing units 731 to 733 and 741 to 743 according to the second embodiment of the present invention. Here, it is assumed that the first to fifth output selecting units 711 to 715 select the output destinations of frequency domain signals on the basis of the correspondence between the window information 761 and the frequency domain signal output destination 762 illustrated in FIG. 7.

Here, a windowing form 771 and a window shape 772 related to the windowing processes performed by the first to sixteenth IMDCT/windowing processing units 731 to 733 and 741 to 743 are illustrated. In this example, the first IMDCT/windowing processing units 731 and 741 perform, on a time domain signal, a windowing process that applies a windowing form of LONG_WINDOW and a window shape of sine window in the first-half portion and the latter-half portion in the windowing form.

In this way, the first to sixteenth IMDCT/windowing processing units 731 to 733 and 741 to 743 generate frequency domain signals of output channels on the basis of the frequency domain signals of the input channels and the window information supplied from the output control unit 710.

[Operation Example of Acoustic Signal Decoding Apparatus 600]

Next, operation of the acoustic signal decoding apparatus 600 according to the second embodiment of the present invention will be described with reference to the drawings.

Figure 9:
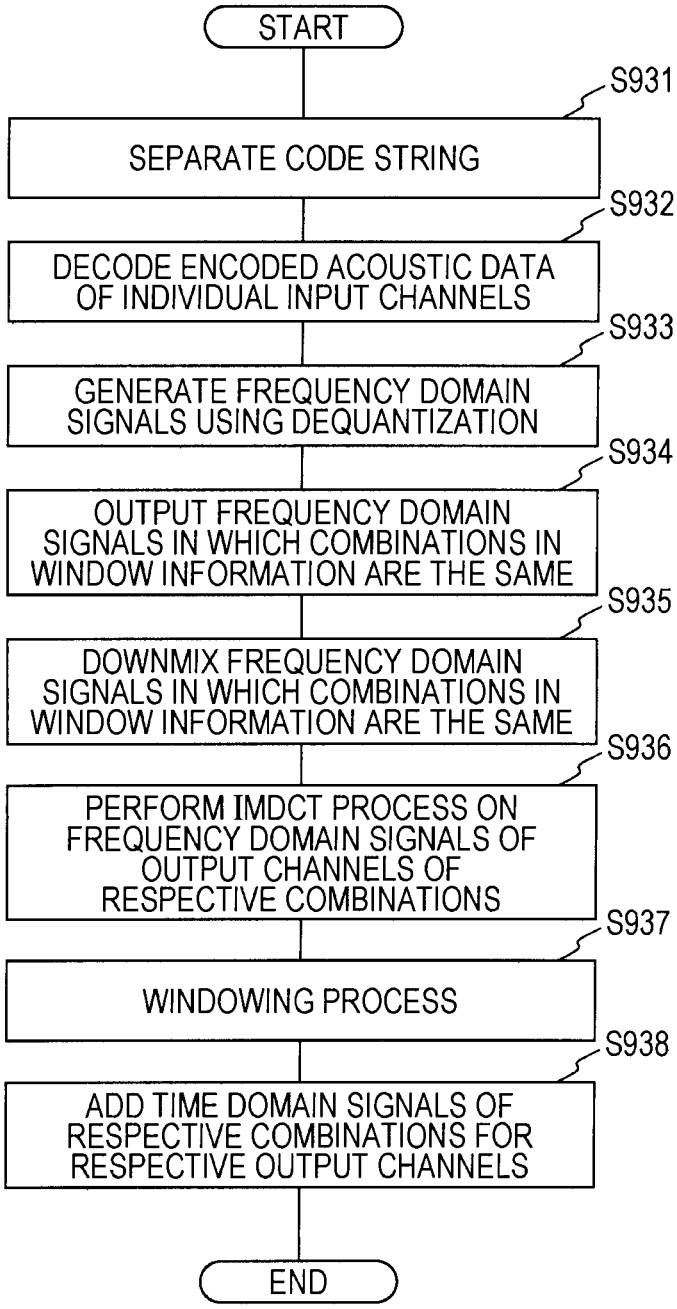
FIG. 9 is a flowchart illustrating a process procedure example of a method for decoding a code string performed by an acoustic signal decoding apparatus 600 according to the second embodiment of the present invention.

FIG. 9 is a flowchart illustrating a process procedure example of a method for decoding a code string performed by the acoustic signal decoding apparatus 600 according to the second embodiment of the present invention.

First, a code example supplied from the code string transmission line 301 is separated into encoded acoustic data of input channels, window information of the input channels, downmix information, and so fourth by the code string separating unit 310 (step S931). Then, the encoded acoustic data of the input channels is decoded by the decoding/dequantizing unit 320 (step S932). Subsequently, the encoded acoustic data that has been decoded is dequantized by the decoding/dequantizing unit 320, so that frequency domain signals are generated (step S933).

Next, on the basis of a plurality of pieces of window information including window shapes, the frequency domain signals in which the combinations in the window information are the same are simultaneously output to the first to sixteenth frequency domain mixing units 721 to 723 corresponding to the respective combinations by the output control unit 710 (step S934). Note that step S934 is an example of the output control procedure described in the claims.

After that, frequency domain signals of the output channels are generated by the first to sixteenth frequency domain mixing units 721 to 723 for the respective combinations in the window information on the basis of the downmix information and the frequency domain signals of the input channels (step S935). That is, on the basis of the downmix information supplied from the code string separating unit 310, the frequency domain signals of the same combinations are mixed by the first to sixteenth frequency domain mixing units 721 to 723, thereby outputting frequency domain signals corresponding to the number output channels smaller than the number of input channels. Note that step S935 is an example of the frequency domain mixing procedure described in the claims.

Then, an IMDCT process is performed on the frequency domain signals of the output channels supplied from the first to sixteenth frequency domain mixing units 721 to 723 by the first to sixteenth IMDCT/windowing processing units 731 to 733 and 741 to 744 (step S936). That is, the individual frequency domain signals of the right channel supplied from the first to sixteenth frequency domain mixing units 721 to 723 are transformed through an IMDCT process by the first to sixteenth IMDCT/windowing processing units 731 to 733, so that time domain signals are generated. Also, the individual frequency domain signals of the left channel supplied from the first to sixteenth frequency domain mixing units 721 to 723 are transformed through an IMDCT process by the first to sixteenth IMDCT/windowing processing units 741 to 743, so that time domain signals are generated.

Subsequently, a windowing process is performed on the generated time domain signals by the respective IMDCT/windowing processing units 731 to 733 and 741 to 743 (step S937). Then, the time domain signals on which the windowing process has been performed by the first to fifteenth IMDCT/windowing processing units 731 to 733 are added for the respective output channels by the adding units 751 and 752, so that acoustic signals are output (step S938).

That is, the frequency domain signals of the output channels supplied from the first to sixteenth frequency domain mixing units 721 to 723 are transformed into time domain signals by the output sound generating unit 730, and a windowing process is performed on the time domain signals obtained through the transform, so that acoustic signals of the output channels are generated. Accordingly, the process procedure in the method for decoding the code string generated by the acoustic signal encoding apparatus ends. Note that steps S936 to S938 are an example of the output sound generation procedure described in the claims.

As described above, in the second embodiment of the present invention, the frequency domain signals that are associated with each other for the respective combinations in the window information by the output control unit 710 are mixed on the basis of the downmix information. Then, the mixed frequency domain signals are transformed into time domain signals, and the time domain signals obtained through the transform are added for the respective output channels, so that acoustic signals of the output channels are generated. Accordingly, unlike in the first embodiment, acoustic signals of the output channels can be generated on the basis of the frequency domain signals of the input channels and downmix information even if all the pieces of window information do not match.

Note that, in this example, when the number of combinations in the window information of the input channels is large, the amount of computation for an IMDCT process may increase compared to the case of downmixing time domain signals of the input channels. For example, when pieces of window information of only two channels match among pieces of window information of five channels, the number of combinations in the window information is four, and the number of frequency domain signals output from the first to sixteenth frequency domain mixing units 721 to 723 is eight (the number of combinations×the number of output channels). Therefore, the first to sixteenth IMDCT/windowing processing units 731 to 733 and 741 to 743 perform an IMDCT process on the frequency domain signals of eight channels.

On the other hand, in the case of downmixing time domain signals, an IMDCT process is performed on the frequency domain signals of five channels corresponding to the number of input channels. Therefore, the amount of computation for the IMDCT process is larger when the frequency domain signals are downmixed. In contrast to this, in a third embodiment, an improvement is made so that the amount of computation for an IMDCT process does not increase compared to the case of downmixing time domain signals of the input channels.

3. Third Embodiment

Configuration Example of Acoustic Signal Decoding Apparatus

Figure 10:
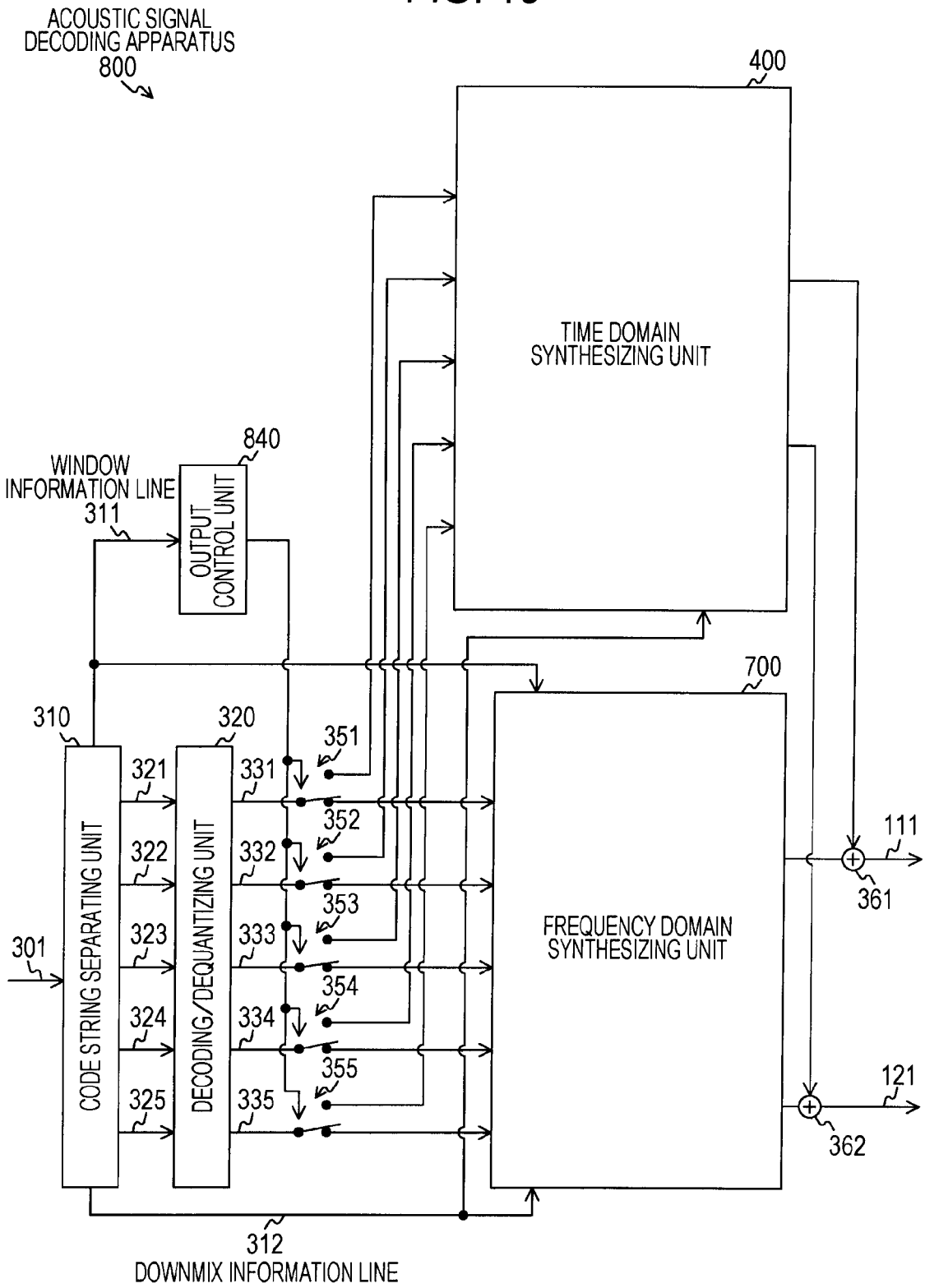
FIG. 10 is a block diagram illustrating a configuration example of an acoustic signal decoding apparatus according to a third embodiment of the present invention.

FIG. 10 is a block diagram illustrating a configuration example of an acoustic signal decoding apparatus according to a third embodiment of the present invention. The acoustic signal decoding apparatus 800 includes the frequency domain synthesizing unit 700 illustrated in FIG. 7 and an output control unit 840, instead of the output control unit 340 and the frequency domain synthesizing unit 500 illustrated in FIG. 4. Here, the configurations other than the frequency domain synthesizing unit 700 and the output control unit 840 are the same as those illustrated in FIG. 4, and are thus denoted by the same reference numerals and the description thereof is omitted here. Furthermore, the function of the frequency domain synthesizing unit 700 is the same as that illustrated in FIG. 7, and thus the description thereof is omitted here. Additionally, the output control unit 840 corresponds to the output control unit 340 illustrated in FIG. 4.

The output control unit 840 performs control to output all the frequency domain signals of the input channels supplied from the decoding/dequantizing unit 320 to one of the time domain synthesizing unit 400 and the frequency domain synthesizing unit 700 on the basis of the number of combinations in the window information of the input channels. The output control unit 840 calculates the number of combinations in the window information on the basis of the window information of the individual input channels supplied from the window information line 311. For example, in a case where only two pieces of window information match among five pieces of window information, the output control unit 840 calculates the number of combinations in the window information to be four.

Also, the output control unit 840 determines whether the product value of the calculated number of combinations and the number of output channels is smaller than the number of input channels or not. That is, the output control unit 840 determines whether the product value of the number of combinations in the window information of the individual input channels supplied from the window information line 311 and the number of output channels is smaller than the number of input channels or not.

Then, if the product value is smaller than the number of input channels, the output control unit 840 controls the output switching units 351 to 355 to simultaneously output the frequency domain signals of the individual input channels to the output control unit 710 in the frequency domain synthesizing unit 700. That is, the output control unit 840 outputs the frequency domain signals of the input channels in which the combinations in the window information are the same to the first to sixteenth frequency domain mixing units 721 to 723 while associating them with each other on the basis of the number of combinations in the window information of the input channels.

On the other hand, in a case where the product value is equal to or larger than the number of input channels, the output control unit 840 controls the output switching units 351 to 355 to output the frequency domain signals of the individual input channels to the IMDCT/windowing processing units 411 to 415 in the time domain synthesizing unit 400. Note that the output control unit 840 is an example of the output control unit described in the claims.

In this way, by providing the output control unit 840, switching to the downmix process in the time domain synthesizing unit 400 can be performed in a case where the product value of the number of combinations in the window information and the number of output channels is equal to or larger than the number of input channels.

[Operation Example of Acoustic Signal Decoding Apparatus 800]

Next, operation of the acoustic signal decoding apparatus 800 according to the third embodiment of the present invention will be described with reference to the drawings.

Figure 11:
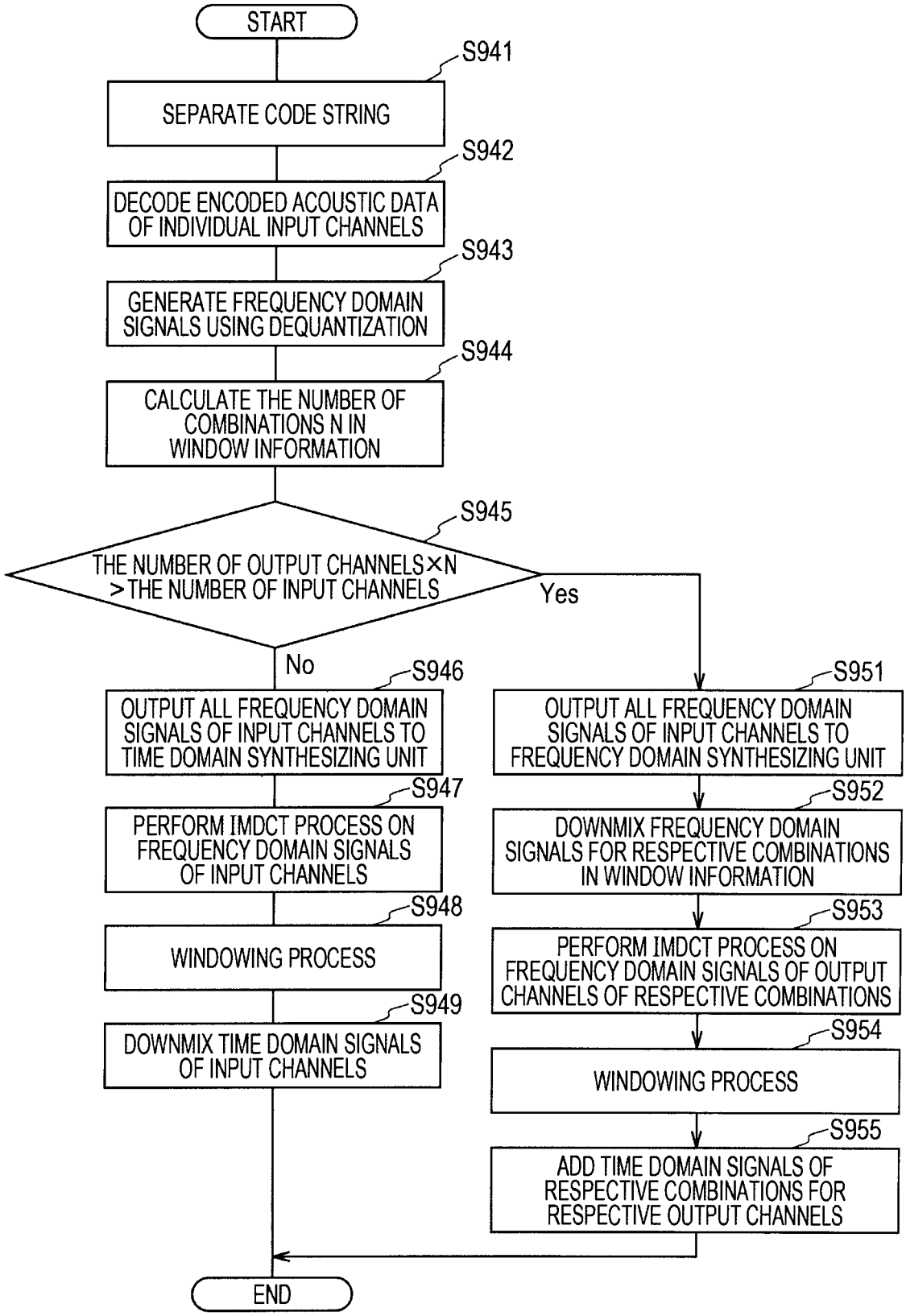
FIG. 11 is a flowchart illustrating a process procedure example of a method for decoding a code string performed by the acoustic signal decoding apparatus 800 according to the third embodiment of the present invention.

FIG. 11 is a flowchart illustrating a process procedure example of a method for decoding a code string performed by the acoustic signal decoding apparatus 800 according to the third embodiment of the present invention.

First, a code example supplied from the code string transmission line 301 is separated into encoded acoustic data of input channels, window information of the input channels, downmix information, and so forth, by the code string separating unit 310 (step S941). Then, the encoded acoustic data of the input channels is decoded by the decoding/dequantizing unit 320 (step S942). Subsequently, the encoded acoustic data that has been decoded is dequantized by the decoding/dequantizing unit 320, so that frequency domain signals are generated (step S943).

Next, the number of combinations N of a windowing form and window shapes included in the window information of the individual input channels supplied from the code string separating unit 310 is calculated by the output control unit 840 (step S944). Subsequently, it is determined whether the product value of the number of combinations N in the window information and the number of output channels is smaller than the number of input channels or not (step S945). Then, if it is determined that the product value is smaller than the number of input channels, the connections of the output switching units 351 to 355 are switched by the output control unit 840 to output all the frequency domain signals of the input channels to the frequency domain synthesizing unit 700 (step S951).

That is, the output switching units 351 to 355 are controlled by the output control unit 840 to simultaneously output the frequency domain signals having the same window information on the basis of the window information including the window shape showing the type of window function. Accordingly, all the frequency domain signals of the input channels output from the decoding/dequantizing unit 320 are supplied to the frequency domain synthesizing unit 700. Note that steps S945 and S951 are an example of the output control procedure described in the claims.

After that, the frequency domain signals in which the combinations in the window information are the same are simultaneously output to the first to sixteenth frequency domain mixing units 721 to 723 corresponding to the respective combinations by the output control unit 710 on the basis of the window information supplied from the window information line 311. Then, frequency domain signals of output channels are generated for the respective combinations in the window information by the first to sixteenth frequency domain mixing units 721 to 723 on the basis of the downmix information and the frequency domain signals of the input channels (step S952).

That is, the frequency domain signals of the same combinations are mixed by the first to sixteenth frequency domain mixing units 721 to 723 on the basis of the downmix information supplied from the code string separating unit 310, thereby outputting frequency domain signals corresponding to the number of output channels smaller than the number of input channels. Note that step S952 is an example of the frequency domain mixing procedure described in the claims.

Then, an IMDCT process is performed on the frequency domain signals of the output channels supplied from the first to sixteenth frequency domain mixing units 721 to 723 by the first to sixteenth IMDCT/windowing processing units 731 to 733 and 741 to 744 (step S953). That is, the individual frequency domain signals of the right channel supplied from the first to sixteenth frequency domain mixing units 721 to 723 are transformed into time domain signals through an IMDCT process by the first to sixteenth IMDCT/windowing processing units 731 to 733. Also, the individual frequency domain signals of the left channel supplied from the first to sixteenth frequency domain mixing units 721 to 723 are transformed into time domain signals through an IMDCT process by the first to sixteenth IMDCT/windowing processing units 741 to 743.

Subsequently, a windowing process is performed on the generated time domain signals by the respective IMDCT/ windowing processing units 731 to 733 and 741 to 743 (step S954). Then, the time domain signals on which the windowing process has been performed by the first to sixteenth IMDCT/windowing processing units 731 to 733 are added for the respective output channels by the adding units 751 and 752, so that acoustic signals are output (step S955).

That is, the frequency domain signals of the output channels supplied from the first to sixteenth frequency domain mixing units 721 to 723 are transformed into time domain signals by the output sound generating unit 730, and a windowing process is performed on the time domain signals obtained through the transform, so that acoustic signals of the output channels are generated. Note that steps S953 to S955 are an example of the output sound generation procedure described in the claims.

On the other hand, in step S945, if the product value is smaller than the number of input channels, the output switching units 351 to 355 are controlled by the output control unit 840 to output all the frequency domain signals of the input channels to the time domain synthesizing unit 400 (step S946). After that, the frequency domain signals of the five input channels are transformed into time domain signals through an IMDCT process by the IMDCT/windowing processing units 411 to 415 (step S947).

Subsequently, a windowing process is performed on the generated time domain signals by the IMDCT/windowing processing units 411 to 415, so that the time domain signals corresponding to the number of input channels are output (step S948). Then, the time domain signals corresponding to the number of input channels are mixed by the time domain mixing unit 420 on the basis of the downmix information supplied from the code string separating unit 310 and acoustic signals of output channels are output (step S949), and then the process in the method for decoding a code string ends.

As described above, in the third embodiment of the present invention, in a case where the amount of computation for an IMDCT process by the frequency domain synthesizing unit 700 is large compared to that in the time domain synthesizing unit 400, switching to the process by the time domain synthesizing unit 400 can be performed. Accordingly, an increase of the amount of computation for an IMDCT process more than necessary can be prevented compared to the second embodiment of the present invention.

As described above, according to the embodiments of the present invention, a computation process for transform into time domain signals can be reduced, and acoustic signals of output channels can be appropriately generated on the basis of window information including window shapes.

Note that the embodiments of the present invention show an example for embodying the present invention, and that the matters in the embodiments of the present invention and the specific matters of the invention in the claims have correspondence as clearly described in the embodiments of the present invention. Likewise, the specific matters of the invention in the claims and the matters having the same names in the embodiments of the present invention have correspondence. However, the present invention is not limited to the embodiments, and can be embodied by making various modifications on the embodiments without deviating from the scope of the present invention.

Also, the process procedures described in the embodiments of the present invention may be regarded as a method having the series of procedures, or may be regarded as a program for causing a computer to execute the series of procedures or a recording medium storing the program. As the recording medium, a CD (Compact Disc), an MD (Mini-Disc), a DVD (Digital Versatile disk), a memory card, a Blu-ray Disc (registered trademark), or the like may be used, for example.

REFERENCE SIGNS LIST

100 acoustic signal processing system
110 right-channel speaker
120 left-channel speaker
200, 600, and 800 acoustic signal encoding apparatus
211 to 215 windowing processing unit
231 to 235 MDCT unit
241 to 245 quantizing unit
250 code string generating unit
260 downmix information receiving unit
300 acoustic signal decoding apparatus
310 code string separating unit
320 decoding/dequantizing unit
340, 710, and 840 output control unit
361, 362, 751, and 752 adding unit
400 time domain synthesizing unit
411 to 415, 521, 522, 731 to 733, and 741 to 743 IMDCT/windowing processing unit
420 time domain mixing unit
500 and 721 to 723 frequency domain synthesizing unit
510 frequency domain mixing unit
520 and 730 output sound generating unit
700 frequency domain synthesizing unit
711 to 715 output selecting unit

The invention claimed is:

1. An acoustic signal decoding apparatus comprising:

an output control unit configured to perform control to simultaneously output frequency domain signals having identical pieces of window information on the basis of the window information including a window shape showing the type of window function related to the frequency domain signals that are obtained by performing a windowing process on acoustic signals of a plurality of input channels;

a frequency domain mixing unit configured to mix the frequency domain signals of the input channels having the identical pieces of window information on the basis of downmix information and output the signals as frequency domain signals corresponding to the number of output channels smaller than the number of the input channels; and an output sound generating unit configured to generate acoustic signals of the output channels by transforming the frequency domain signals of the output channels output from the frequency domain mixing unit into time domain signals and by performing the windowing process on the time domain signals obtained through the transforming.

2. The acoustic signal decoding apparatus according to claim 1, wherein the frequency domain mixing unit mixes the frequency domain signals of the input channels on the basis of the downmix information for respective combinations in the plurality of pieces of window information, and wherein the output sound generating unit generates the acoustic signals of the output channels by adding the time domain signals of the respective combinations on which the windowing process has been performed.

3. The acoustic signal decoding apparatus according to claim 2, wherein the output control unit simultaneously outputs the frequency domain signals of the input channels to the frequency domain mixing unit in a case where a product value of the number of the combinations in the plurality of pieces of window information and the number of the output channels is smaller than the number of the input channels.

4. The acoustic signal decoding apparatus according to claim 1, wherein the output control unit controls output of the frequency domain signals on the basis of the window information that is set on the basis of the acoustic signals of the input channels and that includes a windowing form showing the type of window, and wherein the output sound generating unit generates the acoustic signals of the output channels by performing the windowing process on the frequency domain signals of the output channels on the basis of the windowing form and the type of window function shown in the window information.

5. The acoustic signal decoding apparatus according to claim 4, wherein the output control unit controls output of the frequency domain signals on the basis of the window information showing the window shape for a first-half portion and a latter-half portion in the windowing form.

6. An acoustic signal processing system comprising:

an acoustic signal encoding apparatus including a windowing processing unit configured to perform a windowing process on acoustic signals of a plurality of input channels and generate window information including a window shape showing the type of window function in the windowing process, and a frequency converting unit configured to transform the acoustic signals output from the windowing processing unit into frequency domains, thereby generating frequency domain signals; and an acoustic signal decoding apparatus including an output control unit configured to perform control to simultaneously output the frequency domain signals that are output from the acoustic signal encoding apparatus and that have identical pieces of window information related to the frequency domain signals of the input channels, a frequency domain mixing unit configured to mix the frequency domain signals of the input channels having the identical pieces of window information on the basis of downmix information and output the signals as frequency domain signals corresponding to the number of output channels smaller than the number of the input channels, and an output sound generating unit configured to generate acoustic signals of the output channels by transforming the frequency domain signals of the output channels output from the frequency domain mixing unit into time domain signals and by performing the windowing process on the time domain signals obtained through the transforming.

7. An acoustic signal decoding method comprising:

an output control procedure of performing control to simultaneously output frequency domain signals having identical pieces of window information on the basis of the window information including a window shape showing the type of window function related to the frequency domain signals that are obtained by performing a windowing process on acoustic signals of a plurality of input channels;

a frequency domain mixing procedure of mixing the frequency domain signals of the input channels having the identical pieces of window information on the basis of downmix information and outputting the signals as frequency domain signals corresponding to the number of output channels smaller than the number of the input channels; and an output sound generation procedure of generating acoustic signals of the output channels by transforming the frequency domain signals of the output channels output thorough the frequency domain mixing procedure into time domain signals and by performing the windowing process on the time domain signals obtained through the transforming.

8. A non-transitory storage medium storing a program causing a computer to execute:

an output control procedure of performing control to simultaneously output frequency domain signals having identical pieces of window information on the basis of the window information including a window shape showing the type of window function related to the frequency domain signals that are obtained by performing a windowing process on acoustic signals of a plurality of input channels;

a frequency domain mixing procedure of mixing the frequency domain signals of the input channels having the identical pieces of window information on the basis of downmix information and outputting the signals as frequency domain signals corresponding to the number of output channels smaller than the number of the input channels; and an output sound generation procedure of generating acoustic signals of the output channels by transforming the frequency domain signals of the output channels output thorough the frequency domain mixing procedure into time domain signals and by performing the windowing process on the time domain signals obtained through the transforming.

* * * * *